United States Patent [19]

LeBegue et al.

[11] 4,299,424

[45] Nov. 10, 1981

[54] CUTTING TOOL ASSEMBLY

[75] Inventors: Maurice K. LeBegue, Argillite, Ky.; Charles R. Herron, Bluefield, Va.

[73] Assignee: National Mine Service Company, Pittsburgh, Pa.

[21] Appl. No.: 99,637

[22] Filed: Dec. 3, 1979

[51] Int. Cl.[3] ..... E21C 25/12

[52] U.S. Cl. ..... 299/93

[58] Field of Search ..... 299/86, 91, 92, 79, 299/93

[56] References Cited

U.S. PATENT DOCUMENTS

| | | | |
|---|---|---|---|
| 3,268,260 | 8/1966 | Snipe | 299/91 |
| 3,342,531 | 9/1967 | Krekeler | 299/92 |
| 3,342,532 | 9/1967 | Krekeler | 299/92 |
| 3,397,012 | 8/1968 | Krekeler | 299/86 |
| 3,690,728 | 9/1972 | Krekeler | 299/92 |
| 3,841,708 | 10/1974 | Kniff | 299/86 |
| 3,992,061 | 11/1976 | Rollins | 299/86 |

*Primary Examiner*—William F. Pate, III

*Attorney, Agent, or Firm*—Stanley J. Price, Jr.; John M. Adams

[57] ABSTRACT

A cutting tool assembly adapted for mounting on a driving mechanism of a mining machine to dislodge solid material in mining operations includes a base member rigidly secured as by welding to the driving mechanism. A cutter member having an elongated shank and a conical head is releasably positioned in a bore through the base member. The conical head extends from the upper end of the shank and supports a hard cutting tip that is operable to dislodge solid material from a mine face upon rotation of the driving mechanism. The shank has a tapered body positioned in a tapered portion of the base member bore. The surface of the tapered body cooperates with the bore tapered portion to form a locking fit of the shank in the base member substantially free of relative movement between the shank and the base member to prevent wear of the base member bore. A securing device engages the lower end of the shank to exert a downward force on the shank and urge the complementary surfaces of the shank and the base member into wedging engagement within the bore. Wear of the base member bore is thus substantially prevented resulting in an extended operating life of the base member and reduced downtime for replacing a worn base member.

9 Claims, 6 Drawing Figures

CUTTING TOOL ASSEMBLY

BACKGROUND OF THE INVENTION

1. Field of the Invention

This invention relates to a cutting tool assembly and more particularly to a replaceable cutting tool assembly that is supported by a base member affixed to a driving mechanism in which relative movement between the cutting tool assembly and the base member is prevented to prevent wear of the base member and the need to replace the base member on the driving mechanism.

2. Description of the Prior Art

It is a well known practice in mining operations to mount a plurality of cutting elements on the periphery of a driving mechanism, such as a cylindrical drum, an endless chain, or the like that upon rotation drives the cutting elements into contact with a mine face to dislodge the solid material from the mine face in carrying out the mining operation. Each of the cutting elements includes a bit fabricated of a hard material such as tungsten carbide or other carbide materials. The bit is suitably supported in a cutting position to extend outwardly at a preselected angle from the driving mechanism so that upon rotation of the driving mechanism the bits strike the mine face at an angle to dislodge the mine material from the mine face.

The cutter bits are generally conical in configuration. In one embodiment the the cutter bit includes a shank which is adapted to be detachably received in a socket member of a bit holder that is secured to the periphery of the driving mechanism, such as the surface of a mining machine cutter drum. In another embodiment a conical bit is inserted in a holder that includes a shank portion releasably positioned in the socket of a base member or lug that is secured to the driving mechanism, as for example by welding the lug to the driving mechanism.

The cutter bits are subject to wear under the stresses generated by the cutting operation. Consequently after periods of use the cutter bits become dull or broken and inoperable to efficiently dislodge solid material from the mine face. It is the customary practice to replace dull or broken cutter bits with replacement bits. To facilitate rapid replacement of a worn cutter bit in a base member or lug a variety of "knock-out" bits have been developed to reduce the downtime of the mining machine for bit replacement.

The stresses generated by the cutting operation on the cutter bits not only accelerate wear of the cutter bits but also generate wear of the base member that is welded to the driving machine. When worn base members are not replaced the efficiency of the mining operation is also impaired. Because the base members or lugs are secured by welding to the driving mechanism, their replacement is difficult, resulting in considerable downtime for the mining machine. One approach to reducing wear of the base members and the corresponding downtime in their replacement has been to rotatably support the cutter bit in the base member. This arrangement is illustrated in U.S. Pat. No. 3,397,012.

It is also known to rotatably position a cutter bit within a bore of a bit holder, and rotatably position the bit holder within the bore of a support block that is welded to the surface of a drum, as illustrated in U.S. Pat. Re. No. 29,900. With this arrangement the bit holder is axially and rotatably movable within the bore of the support block. Consequently, the support block is subject to wear requiring its replacement which, as above discussed, is difficult and time consuming.

U.S. Pat. No. 3,690,728 discloses a spring clip for securing the shank of a cutter bit, either rotatably or nonrotatably, in the shank receiving perforation of a lug-type tool holder assembly. Nevertheless, the shank receiving perforation is still subject to wear. When wear of the tool holder begins to diminish the efficiency of the mining machine, then the tool holder must be replaced.

It has been the approach in the past to rotatably position the bit holder in the bore of the base member to provide uniform wear of the cutter bit. This approach is disclosed in U.S. Pat. Nos. 3,342,531; 3,342,532; 3,992,061; and Re. 29,900. For the bit holder to be rotatable it is necessary that the bit holder be fully seated in the bore of the base member. If the seating of the bit holder in the bore is improper or a slight misalignment exists between the complementary bearing surfaces of the bit holder and the base member, then the bit holder and the base member will be become worn under the stresses of the cutting operation.

While replacement of a worn bit holder consumes a minimum of time, replacement of a worn base member is very time consuming. The worn base member, which is welded to the driving mechanism, must first be removed. The replacement base member must be positioned in the proper location on the driving mechanism to coordinate the location of the cutter bit with the other cutter bits on the driving mechanism. Then the replacement base member must be welded to the surface of the driving mechanism. Consequently, the mining machine is removed from operation for a considerable period of time during the replacement operation.

It is also known to reduce the stresses exerted on the base member during the mining operation by forming complementary bearing surfaces between either the cutter bit or the bit holder and the base member. Cutter bit assemblies having complementary bearing surfaces are disclosed in U.S. Pat. Nos. 3,342,531; 3,342,532; 3,992,061; and Re. 29,900. The complementary bearing surfaces are generally formed by a tapered body portion of the cutter bit or bit holder engaging a frusto-conical seat in the the base member. Also it is known to provide complementary bearing surfaces between the cutter bit and the bit holder to ensure that the cutter bit is fully seated in the bit holder but rotatable in the bit holder.

For the arrangement in which the tapered body of the bit holder engages the frusto-conical seat of the base member, axial movement of the bit holder in the base member is permitted so that the bit holder will rotate in the base member. However, if the complementary bearing surfaces are not fully engaged and are retained in a misaligned position, then the complementary bearing surfaces will wear relatively rapidly. As a result the bit holder and the base member will require replacement.

There is need in mining operations for a cutter bit assembly including a cutter bit and bit holder that are replaceable in a base member affixed to the driving mechanism of the mining machine in a manner that substantially reduces the wear of the base member and the frequency of replacement of the base member in order to reduce the downtime for the mining machine. While it has been suggested to provide complementary bearing surfaces between a rotatable cutter bit or bit holder and the base member, elaborate retention devices are required to maintain the complementary bearing surfaces fully seated and rotation is permitted between the complementary bearing surfaces resulting in accelerated wear of the bearing surface of the base member.

SUMMARY OF THE INVENTION

In accordance with the present invention there is provided a cutting tool assembly that includes a cutter member having an elongated shank portion and a head portion. The shank portion has an upper first end portion and a lower second end portion. The head portion extends from the shank portion upper first end portion and has a cutting tip extending from one end thereof. The shank portion has a tapered body. The base member has a longitudinal bore extending therethrough. The bore has a tapered portion for receiving the tapered body of the shank portion. The tapered body engages the base member in the bore tapered portion to form a locking tapered fit between the shank portion and the base member substantially free of relative movement between the shank portion and the base member to prevent wear of the bore tapered portion. Securing means engages the shank portion to retain the tapered body immovable with the bore tapered portion.

The tapered body of the shank portion has a circular cross section that varies in diameter the length of the tapered body. The bore tapered portion has a circular cross section varying in diameter the length thereof so that the tapered body engages the bore tapered portion the length thereof and is immovably positioned within the base member. Thus with this arrangement the tapered body of the shank portion and the bore tapered portion have complementary bearing surfaces maintained in wedging engagement free of relative movement between the bearing surfaces. The securing means is operable to maintain the tapered body in the bore tapered portion to maintain the complementary surfaces thereof in wedging engagement.

The securing means is positioned in abutting relation with the base member and frictionally engages the shank lower second end portion. In this manner the securing means is operable to exert an axial force on the shank lower second end portion and urge the cooperating surfaces of the tapered body and the bore tapered portion into locking engagement. The shank portion is thus restrained from moving in the base member bore.

In one embodiment the securing means extends through the base member and into the base member bore. A cylindrical portion extending from the shank lower second end portion is positioned oppositely of the securing means in the base member bore. The securing means is wedged between the base member and the shank cylindrical portion. In this manner the shank portion is maintained immovable within the base member.

In the second embodiment of the securing means a threaded end portion extends from the shank lower second end portion and projects out of base member bore. The securing means is provided with an internally threaded bore that engages the shank threaded end portion. With this arrangement the securing means is rotatably advanced in a first direction on the shank threaded end portion into abutting relation with the base member so that upon further rotation the shank portion is drawn into the base member bore and into locking engagement with the base member.

Accordingly, the principal object of the present invention is to provide a cutting tool assembly that is adaptable for dislodging solid material in mining operations and includes a cutter bit that is releasably retained in a base member affixed to a driving mechanism with the cutter bit supported by the base member in a manner to substantially prevent wear of the base member and thereby extend the life of the base member.

Another object of the present invention is to provide a cutting tool assembly that includes a holder having a conical cutting tip releasably secured thereto and a base member affixed, as by welding, to a driving mechanism and provided with a tapered bore arranged to receive a complementary tapered surface of the holder to provide locking engagement of the holder in the base member and substantially prevent wear of the base member.

These and other objects of the present invention will be more completely disclosed and described in the following specification, the accompanying drawings, and the appended claims.

DESCRIPTION OF THE PREFERRED EMBODIMENTS

Figure 1:
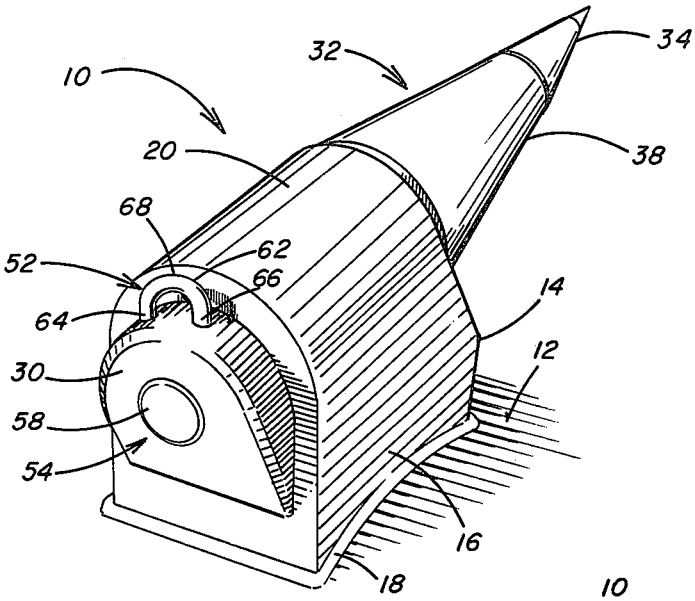
FIG. 1 is a schematic isometric view of one embodiment of the cutting tool assembly of the present invention.

Referring to the drawings in which like numerals refer to like parts throughout the drawings there is illustrated a cutting tool assembly generally designated by the numeral 10 that is operable to be secured to the driving mechanism of a mining machine for dislodging solid material from a mine face in a mining operation. The cutting tool assembly may be affixed to the surface of the driving mechanism as by welding or any other suitable means. It should be understood that the driving mechanism may include conventionally known cutter chains, cutter drums or wheels, rotary cutter bars, cutter arms or the like associated with a mining machine. The driving mechanism supports the cutting tool assembly 10 in a preselected orientation for dislodging solid material from a mine face as the driving mechanism rotates.

As illustrated in FIGS. 1, 2, 4, and 5, the cutting tool assembly is positioned on an arcuate surface 12 of the driving mechanism. A base member 14 of the assembly 10 has a lower end portion 16 having an arcuate configuration to provide complementary surfaces between the base member 12 and the driving mechanism. The lower end portion 16 abuts the arcuate surface 12 and is secured thereto in a rigid manner, such as by welding the outer periphery of the lower end portion 16 to the arcuate surface 12. By welding the base member 14 to the arcuate surface 12 a weld head 18 is formed around the periphery of the base member lower end portion 16.

The base member 14 includes a body portion 20 that extends upwardly from the arcuate surface 12, and a longitudinal bore 22 extends through the body portion 20. Preferably the longitudinal axis of the bore 22 is positioned at an acute angle with respect to the surface 12 of the driving mechanism as required to perform the material dislodging operation by rotation of the driving mechanism. The bore 22 has a tapered portion 24 and a cylindrical portion 26. The tapered portion 24 extends through upper surface 28 of the base member body portion 20 and the cylindrical portion extends through the lower surface 30 of the base member body portion 20.

A cutter member generally designated by the numeral 32 having a conical cutting tip 34 extending therefrom is positioned within the base member bore 22. The cutter member 32 is provided with an elongated shank portion 36 and a head portion 38. The shank portion 36 has an upper first end portion 40 and a lower second end portion 42. A tapered body portion 44 extends between the end portions 40 and 42. The head portion 38 extends from the shank upper first end portion 40 and has a frusto-conical configuration.

An axial bore 46 extends from end 48 of head portion 38 to a preselected depth therein. The conical cutting tip 34 includes a shaft portion 50. The shaft portion 50 is releasably secured in a conventional manner as known in the art to facilitate efficient replacement of the cutting tip 34 in the bore 46. The shaft 50 is rotatable in the bore 46 to permit uniform wear of the cutting tip 34. The cutting tip 34 extends outwardly from the end 48 and is positioned at the preferred angle for dislodging solid material from a mine face by striking the mine face upon rotation of the driving mechanism. The cutting tip 34 is fabricated of a hard material such as tungsten carbide, or other suitable carbide materials and the like.

In accordance with the present invention the tapered body 44 of the shank portion 36 engages the base member 14 in the bore 22 to form a locking tapered fit between the shank portion 36 and the base member 14 which locking tapered fit is substantially free of relative movement between the shank portion 36 and the base member 14. This arrangement serves to substantially prevent wear of the base member bore 22. To retain the shank portion 36 in locked engagement with the base member 14, a securing device generally designated by the numeral 52 is mounted on the shank lower second end portion 42 and is engageable with the base member 14.

The securing device 52 is operable to exert a downward axial force upon the shank portion 36 so that complementary bearing surfaces of the shank tapered body 44 and the base member tapered bore 24 are urged into wedging engagement. Preferably the complementary bearing surfaces are free of relative movement. By preventing relative movement between the shank tapered body 44 and the base member tapered bore 24 wear of the base member 14 around the tapered bore 24 is prevented. In this manner the operating life of the base member 14 is substantially increased. Thus the problem of lost mining production due to the downtime of the mining machine for replacement worn base members is avoided.

In order to facilitate wedging engagement of the shank portion 36 with the base member 14, the tapered body 44 is provided with a circular cross section that varies in diameter from the upper first end portion 40 to the lower second end portion 42. Preferably the shank portion 36 has a maximum diameter at the upper first end portion 40 and a minimum diameter at the lower second end portion 42. Accordingly the bore tapered portion 24 is provided with a circular cross section that also varies in diameter the length thereof. The bore tapered portion 24 has a maximum diameter adjacent the upper end 28 and a minimum diameter adjacent the lower end 30. This arrangement provides complementary bearing surfaces of a substantial length.

The shank portion 36 engages the base member 14 in the bore 22 substantially along the entire length of the shank portion 36. The cutter member 32 is thus stabilized in the base member 14 so that the cutter member when engaged by the securing device 52 is relatively immovable within the base member 14. Preventing relative movement between the cutter member 32 and the base member 14 prevents wear of the base member. Downtime for the mining machine is consequently limited to replacement of the cutter member 32 in the base member 14 which replacement is accomplished with relative ease requiring only a minimum downtime for the mining machine.

Figure 2:
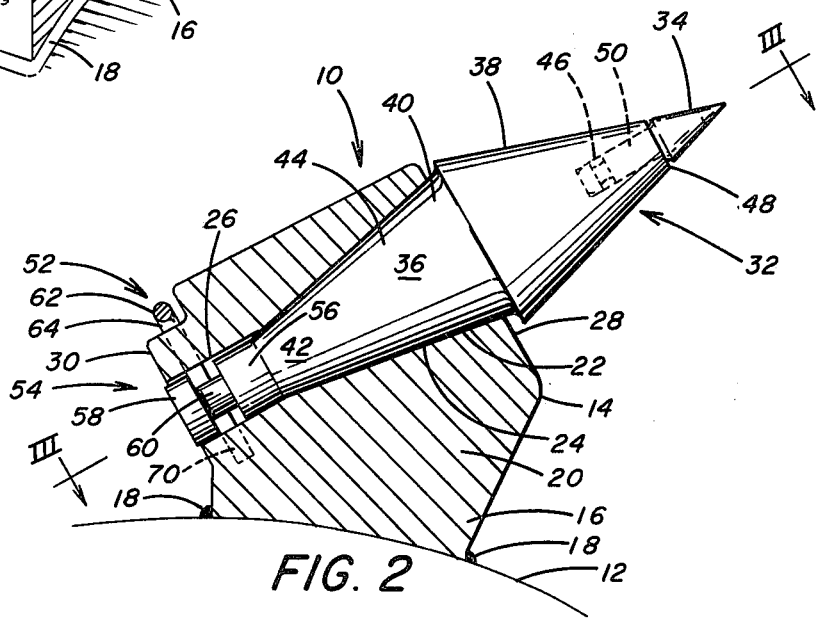
FIG. 2 is sectional view in side elevation of the cutting tool assembly shown in FIG. 1, illustrating the tapered body of a cutter bit holder engaged in the tapered bore of a base member with means for locking the holder in the base member to prevent relative movement therebetween.
Figure 3:
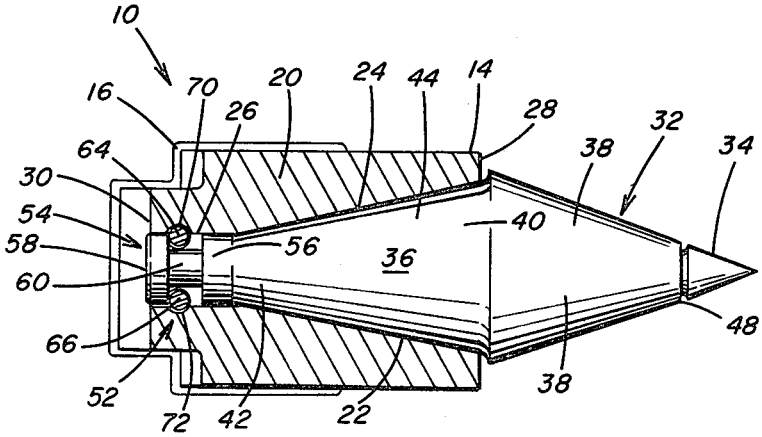
FIG. 3 is a sectional view taken along line III—III of FIG. 2.

Now referring to the embodiment of the present invention illustrated in FIGS. 1–3, a cylindrical portion generally designated by the numeral 54 in FIGS. 2 and 3 extends from the shank lower second end portion 42. The cylindrical portion 54 is positioned within the bore cylindrical portion 26. The cylindrical portion 54 has a pair of enlarged diameter end portions 56 and 58 separated from one another by a reduced diameter portion 60. The securing device 52 shown in FIGS. 1–3 is operatively associated with the cylindrical portion 54 of the shank portion 36.

In this embodiment the securing device 52 includes a spring clip 62 having a pair of spring arms 64 and 66 connected at end portion 68. A pair of apertures 70 and 72 extend through the lower end 40 of the base member 14. The apertures 70 and 72 communicate with the bore cylindrical portion 26 opposite of the reduced diameter portion 60 of the shank cylindrical portion 54. With this arrangement the apertures 70 and 72 are arranged to receive the spring arms 64 and 66.

The spring arms 64 and 66 are compressed slightly as they are inserted in the apertures 70 and 72. The spring arms 64 and 66 extend through the bore cylindrical portion 26 and are urged by either one of the enlarged diameter portions 56 or 58, as for example enlarged diameter portion 58 as illustrated in FIG. 3, and the base member body portion 20 surrounding the bore 26 and apertures 70 and 72 into frictional engagement with the reduced diameter portion 60. The spring arms 64 and 66 are thus wedged between the base member body portion 20 and the shank cylindrical portion 54 surrounding the reduced diameter portion 60. The shank cylindrical portion 54 is blocked from forward movement in the bore 26. The spring arms 64 and 66 exert a rearward axial force upon the enlarged diameter portion 58 forcing the shank portion 36 rearwardly in the bore 20. As a result the complementary bearing surfaces of the shank portion 36 and the base member 14 are locked in wedging engagement.

Figure 4:
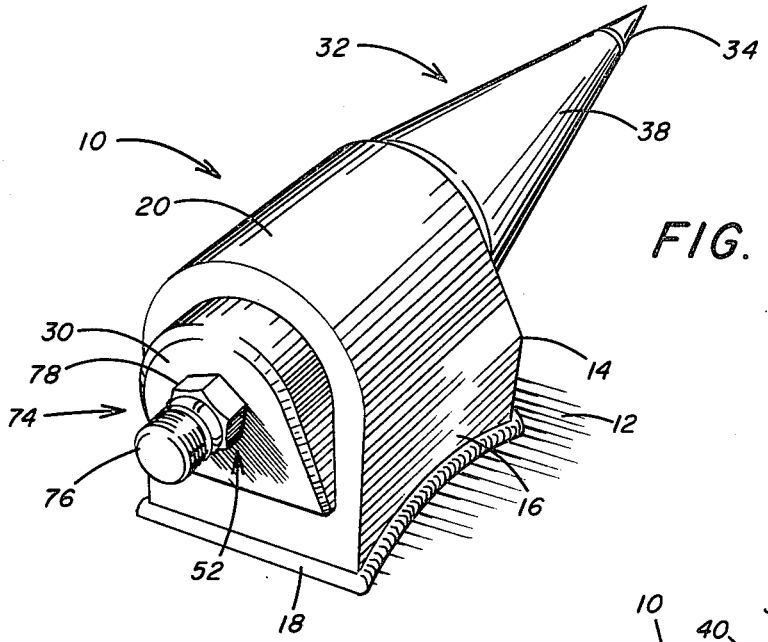
FIG. 4 is a schematic isometric view of another embodiment of the cutter tool assembly of the present invention.
Figure 5:
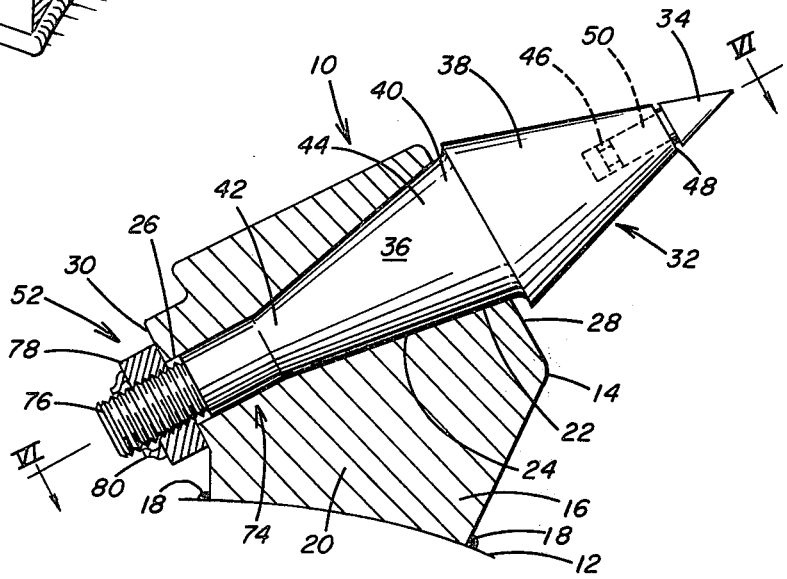
FIG. 5 is a sectional view in side elevation of the cutter tool assembly shown in FIG. 4, illustrating means for threadedly engaging the end of the cutter bit holder to retain the complementary tapered surfaces of the holder and the base member in wedging engagement and free of relative movement therebetween.
Figure 6:
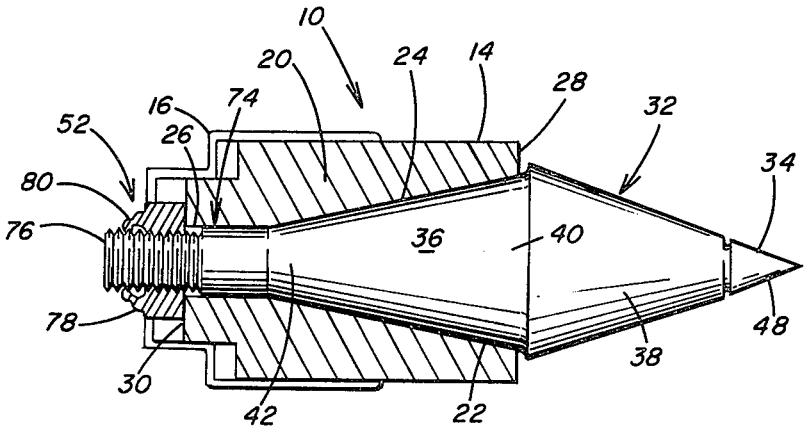
FIG. 6 is a sectional view taken along line V—V of FIG. 5.

Now referring to the embodiment of the present invention illustrated in FIGS. 4–6 there is illustrated a cylindrical portion generally designated by the numeral 74 that extends from the shank lower second end portion 42. The cylindrical portion 74 extends through the bore cylindrical portion 26 and includes a threaded end 76 that projects out of the bore cylindrical portion 26. The securing device 52 is adapted to threadedly engage the threaded end 76 to maintain the complementary bearing surfaces of the shank portion 36 and the base member 14 wedged in locking engagement to prevent relative movement between the shank portion 36 and the base member 14.

In this embodiment the securing device 52 includes a self-locking nut 78 that is internally threaded to engage the threaded end 76. The self-locking nut 78 is threadedly advanced onto the threaded end 76 into abutting relation with the lower end 30 of base member 14. Upon further rotation of the nut 78 the shank portion 36 is drawn axially downwardly into the bore 22 urging the tapered bearing surface of the shank portion 36 into wedging engagement with the complementary tapered bearing surface of the base member 14 surrounding the bore tapered portion 24.

The self-locking nut 78 includes a flanged end portion 80, that is arranged when the nut 78 is rotated into abutting relation with the base member lower end 30, to engage the threaded end 76 to prevent relative movement of the nut 78 on the threaded end 76. In this manner the nut 78 is retained in a locked position on the threaded end 76 in abutting relation with the base member lower end 30. Consequently, the complementary tapered bearing surfaces of the shank portion 36 and the base member 14 are maintained in locked engagement preventing relative movement between the shank portion 36 and the base member 14. Accordingly, when it is desired to remove the cutter member 32 from the base member 14, the nut 78 is threadedly advanced in a second direction out of engagement with the threaded end 76. With the nut 78 removed from the threaded end 76, the cutter member 32 is free to be removed from the base member bore 22.

According to the provisions of the Patent Statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A cutting tool assembly comprising, a cutter member having an elongated shank portion and a head portion, said shank portion having an upper first end portion and a lower second end portion, said head portion extending from said shank portion upper first end portion and having a cutting tip extending from one end thereof, said shank portion having a combined upper elongated tapered body portion and a lower elongated cylindrical body portion, a base member having a longitudinal bore extending therethrough, said bore having an elongated tapered portion for receiving said shank tapered body of said shank portion and an elongated cylindrical portion for receiving said shank cylindrical body portion, said bore elongated tapered portion extending from an upper end of said base member into said base member and said elongated cylindrical portion extending from said bore elongated tapered portion through said base member to a lower end of said base member, said shank tapered body portion decreasing in diameter along the length thereof to the diameter of said shank cylindrical body portion, said bore elongated tapered portion decreasing in diameter along the length thereof so that the portion of said base member surrounding said bore elongated tapered portion engages said shank tapered body portion along the entire length of said shank tapered body portion, said shank tapered body portion including a maximum diameter portion at an upper end thereof and a minimum diameter portion at a lower end thereof with an intermediate diameter portion progressively decreasing in diameter from said shank tapered upper end to said shank tapered lower end, said bore elongated tapered portion including a maximum diameter portion at an upper end thereof and a minimum diameter portion at a lower end thereof with an intermediate diameter portion progressively decreasing in diameter from said bore tapered upper end to said bore tapered lower end, said bore tapered lower end abutting said bore cylinder portion, said bore tapered maximum, intermediate, and minimum diameter portions being in complementary engagement with said shank tapered maximum, intermediate, and minimum diameter portions, said shank cylindrical body portion having an extended length to ensure extension of said shank cylindrical body portion through said bore elongated cylindrical portion to the extreme lower end of said bore, said shank cylindrical body portion and said bore elongated cylindrical portion having complementary diameters to ensure contact of said shank cylindrical body portion with the surrounding base member free of lateral movement in said bore elongated cylindrical portion, securing means for engaging said shank cylindrical body portion to retain said shank portion within said bore, and said securing means being operable to exert a downward axial force upon said shank cylindrical body portion to urge said complementary bearing surfaces into wedging engagement and form a locking tapered fit between said shank tapered body portion and said base member surrounding said bore elongated tapered portion substantially free of relative movement between said shank portion and said base member to prevent wear of said bore elongated tapered portion.

2. A cutting tool assembly as set forth in claim 1 which includes, said tapered body of said shank portion having a circular cross section varying in diameter the length of said tapered body, and said bore tapered portion having a circular cross section varying in diameter the length thereof so that said tapered body engages said bore tapered portion the length thereof and is immovably positioned within said base member.

3. A cutting tool assembly as set forth in claim 1 which includes, said tapered body of said shank portion terminating in said cylindrical portion having a preselected diameter, said bore tapered portion terminating in a bore tubular portion having a diameter corresponding to the diameter of said cylindrical portion, and said bore tapered portion decreasing in diameter along the length thereof to the diameter of said bore tubular portion.

4. A cutting tool assembly as set forth in claim 1 which includes, said base member being adapted for rigid mounting on a driving mechanism, and said securing means being operable to be disengaged from said shank portion to permit removal of said shank portion from said base member to facilitate replacement of a damaged cutter member in said base member.

5. A cutting tool assembly as set forth in claim 1 which includes, said securing means being positioned in abutting relation with said base member and frictionally engaging said shank cylindrical body portion, and said securing means being operable to exert a rearward axial force on said shank cylindrical body portion to urge said complementary bearing surfaces of said shank tapered body portion and said bore tapered portion into locking engagement whereby said shank portion is restrained from moving in said base member.

6. A cutting tool assembly as set forth in claim 1 which includes, said head portion having a bore axially aligned with said shank portion and said base member bore, and said cutting tip having a rotatable shaft portion releasably secured within said head portion bore and a conical end extending axially out of said head portion bore.

7. A cutting tool assembly as set forth in claim 1 which includes, said shank cylindrical body portion having a pair of enlarged diameter portions separated by a reduced diameter portion, said securing means extending through said base member and into said bore elongated cylindrical portion, and said securing means abutting said base member and one of said enlarged diameter end portions and urged into wedging engagement with said reduced diameter portion to retain said shank portion immovable within said base member.

8. A cutting tool assembly as set forth in claim 1 which includes, said shank cylindrical body portion including a threaded end portion, said threaded end portion projecting out of said bore elongated cylindrical portion, said securing means having an internally threaded portion arranged to engage said threaded end portion, and said securing means being rotatably advanced in a first direction on said threaded end portion into abutting relation with said base member so that upon further rotation of said securing means said shank portion is wedged into locking engagement with said base member in said bore thereof.

9. A cutting tool assembly as set forth in claim 8 which includes, locking means on said securing means for engaging said threaded end portion to prevent relative movement between said securing means and said base member and maintain locked engagement of said shank portion with said base member, and said securing means being rotatably advanced in a second direction on said threaded end portion out of engagement with said threaded end portion to permit removal of said shank portion from said base member bore.

* * * * *